US006932043B2

(12) United States Patent
Callini et al.

(10) Patent No.: US 6,932,043 B2
(45) Date of Patent: Aug. 23, 2005

(54) ANCILLARY UNIT DRIVE ADAPTER

(75) Inventors: Sergio Callini, Milan (IT); Aldo Banchio, Turin (IT)

(73) Assignees: Cummins Engine Compnay, Ltd., Darlington (GB); IVECO (UK) Ltd., Watford (GB); CNH, UK, Basildon (GB)

( * ) Notice: Subject to any disclaimer, the term of this patent is extended or adjusted under 35 U.S.C. 154(b) by 0 days.

(21) Appl. No.: 10/614,746

(22) Filed: Jul. 7, 2003

(65) Prior Publication Data

US 2004/0079320 A1 Apr. 29, 2004

(30) Foreign Application Priority Data

Jul. 6, 2002 (GB) ..... 0215734

(51) Int. Cl.[7] ..... F02B 67/04
(52) U.S. Cl. ..... 123/195 R
(58) Field of Search ..... 123/195 R, 198 R, 123/509, 195 A, 198 C; 74/397, 325

(56) References Cited

U.S. PATENT DOCUMENTS 4,479,463 A 10/1984 Curley et al.
4,488,447 A * 12/1984 Gebhardt ..... 74/397
5,535,643 A 7/1996 Garza
6,286,475 B1 * 9/2001 Pierro ..... 123/195 A

FOREIGN PATENT DOCUMENTS

| | | | |
|---|---|---|---|
| EP | 0789165 | A1 | 2/1997 |
| EP | 979957 | A2 | 8/1999 |
| EP | 1081344 | A1 | 9/2000 |
| GB | 228047 | A | 8/1990 |
| JP | 58-160644 | | 9/1983 |
| JP | 6-346790 | | 12/1994 |
| JP | 8-177446 | | 9/1996 |
| JP | 2000-65147 | | 3/2000 |

* cited by examiner

*Primary Examiner*—Henry C. Yuen
*Assistant Examiner*—Hyder Ali
(74) *Attorney, Agent, or Firm*—Woodard, Emhardt, Moriarty, McNett & Henry LLP

(57) ABSTRACT

An ancillary unit drive adapter is disclosed for use in an engine block which has at one end a lateral flange formed with an aperture for mounting of the ancillary unit. The drive adapter comprises a casing (112) for mounting on the end face of the engine to overlie the aperture. A shaft (116) journalled in the casing, has a formation (122) at one end for coupling to the input shaft of the ancillary unit and a cog (120) solid with its opposite end for meshing with an engine driven gear. Faces (**120*a*, 120*b*) on the opposite sides of the cog (120) serve in use as bearing surfaces to withstand axial forces acting in both directions on the drive shaft (116**).

8 Claims, 2 Drawing Sheets

ANCILLARY UNIT DRIVE ADAPTER

FIELD OF THE INVENTION

The present invention relates to an ancillary unit drive adapter for use in an engine block which has at one end a lateral flange formed with an aperture for mounting the ancillary unit.

BACKGROUND OF THE INVENTION

The invention particularly finds application in so-called structural engines, as used in agricultural tractors. Instead of being supported on resilient mounts on a vehicle body or chassis, a structural engine and its transmission train together form the unsprung mass or chassis of the vehicle. For this reason, the engine block needs to be designed to provide strength and rigidity.

The rear end of the block of a structural engine commonly has a flange that projects laterally and is used to support ancillary units, such as a fuel pump and a hydraulic pump to be driven by the crankshaft. The ancillary unit mates with the forward facing surface of the lateral flange and this surface must therefore be machined accurately after the engine block has been cast. However, in a structural engine, for additional strength, the block has laterally projecting ribs that are joined to the lateral flange on which the ancillary unit is mounted and these ribs interfere with the machining of the forward facing surface of the flange.

In order to enable an ancillary unit to be mounted on the lateral end flange of an engine without the need to machine the forward facing surface of the end flange, it has been proposed in EP-A-0.992.672 to mount an adapter on the rear end face of the lateral flange to overlie the aperture for the ancillary unit, the surface of the adapter plate facing the aperture being machined to mate with an ancillary unit disposed on the other side of the flange and secured to the adapter plate through the aperture in the lateral flange.

As a development of the adapter plate disclosed in EP-A-0.992.672, it has also previously been proposed to provide a drive adapter as shown in FIG. 1 of the accompanying drawings. The known adapter comprises a casing 12 for mounting on the end face of the lateral flange 10 to overlie the aperture, which casing 12 is sealed relative to the aperture by means of O-rings 28 and 30. The casing 12 has ears 14 for receiving bolts that secure the adapter to the end face of the engine. A drive shaft 16, which is journalled in the casing 12 by means of bearing shells 18, is formed at one end with a formation, such as a splined hole 22, for enabling the drive shaft 16 to be coupled to the input shaft of the ancillary unit. At its other end, the drive shaft 16 is provided with a cog 20 that meshes with the flywheel or another engine driven gear. The drive shaft 16 is formed with a double shoulder 24 and the cog 20 fits over a reduced diameter portion of the shaft 16. A retaining plate 26 screwed to the casing 12 abuts the shoulder 24 and the cog 20 to resist axial loads on the shaft 16 and holds the shaft 16 in the casing 12.

The present invention seeks to improve on the known drive adapter by reducing the number of components employed in its manufacture and their complexity.

SUMMARY OF THE INVENTION

According to the present invention, there is provided an ancillary unit drive adapter for use in an engine block which has at one end a lateral flange formed with an aperture for mounting of the ancillary unit, the drive adapter comprising a casing for mounting on the end face of the engine to overlie the aperture, a shaft journalled in the casing, a formation at one end of the shaft to enable the shaft to be coupled to the input shaft of the ancillary unit and a cog solid with the opposite end of the shaft for meshing with an engine driven gear, characterised in that faces on the opposite sides of the cog serve in use as bearing surfaces to withstand axial forces acting in both directions on the drive shaft.

Because of the fact that the cog is used in the present invention to withstand axial loads on the drive shaft, the part of the drive shaft engaged by the cog may preferably have the same diameter as the part journalled in the casing.

Aside from avoiding the need to machine a shoulder on the drive shaft, there is no need in the present invention for a retaining plate to be screwed to the casing to hold the drive shaft in place. The assembly of the adapter is further simplified in that the cog can be fitted to the drive shaft and the latter can then simply be inserted into the casing. By contrast, in the prior art construction the retaining plate 26 and the cog 20 needed first to be fitted to the shaft 16. Thereafter, the retaining plate 26 had to be screwed to the casing 12 by passing a tool through access holes (not shown) provided for this purpose in the cog 20.

For convenience, in the ensuing description, it will be assumed that the end of the block on which the lateral flange is formed is the rear end to which the gearbox housing is connected but the invention is equally applicable to either end of the engine.

The simplification afforded by the present invention is predicated on the realisation that when the adapter is in situ the cog is held captive between the end face of the engine and the flywheel cover (or engine front cover). It is therefore possible to take up axial loads on the shaft by using end faces of the cog as axial thrust bearings, and one may thus dispense with the retaining plate and the need to machine a shoulder on the drive shaft.

In a preferred embodiment of the invention, the drive shaft is formed as a hollow shaft. This enables simple broaching of a splined formation at one end of the shaft and also, with the provision of suitable oil galleries, permits oil for lubrication to reach the splined formation and the axial bearing surfaces of the cog.

The invention in common with that in EP-A-0.992.672 avoids the need to machine the forward facing surface of the lateral flange by mounting an adapter on its rear side so that the ancillary unit mates with the adapter rather than with the flange. This allows the face to which the ancillary unit mates to be machined without hindrance from any part of the block. The adapter needs itself to be mounted on a machined surface on the flange but as this surface is outward facing, it can readily be machined at the same time as other parts of the end surface of the engine block that mate with the gearbox (or the engine front cover).

A further advantage is that the same engine block can be used with ancillary units of different design by changing only the adapter. Hence, by using an alternative adapter, it is possible to move the centre of the drive shaft of the ancillary unit radially with respect to the crankshaft axis.

BRIEF DESCRIPTION OF THE DRAWINGS

The invention will now be described further, by way of example, with reference to the accompanying drawings, in which.

DESCRIPTION OF THE PREFERRED EMBODIMENT

Figure 1:
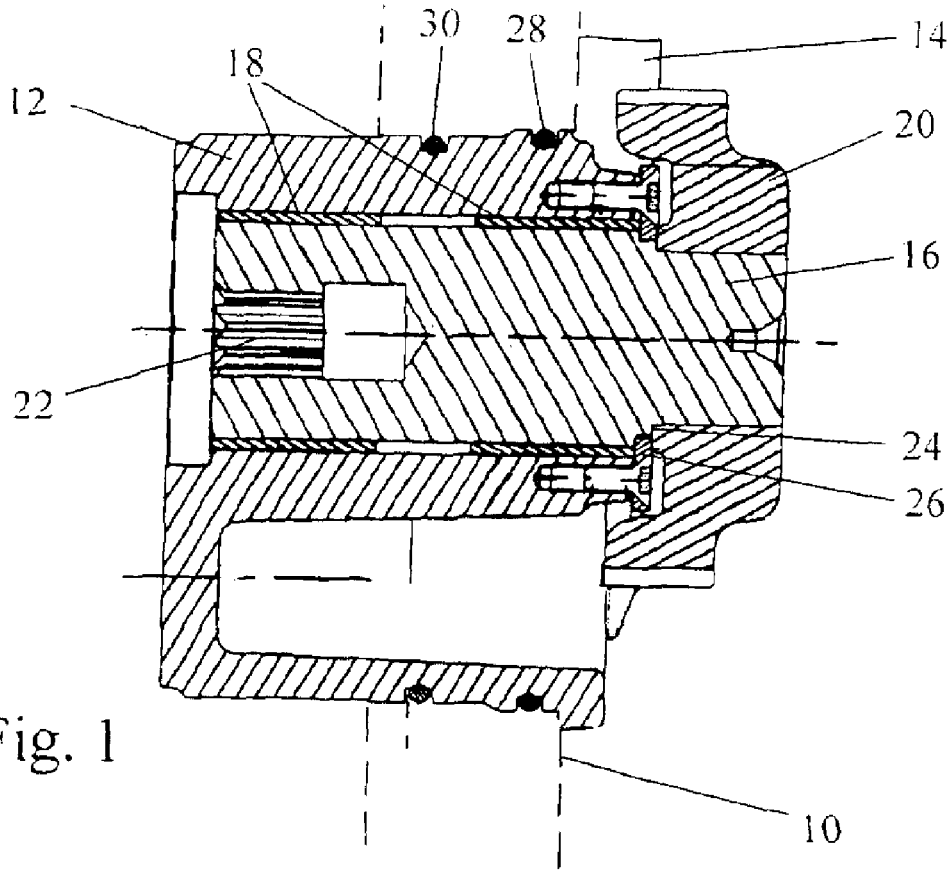
FIG. 1 is, as described above, a section through a known drive adapter.
Figure 2:
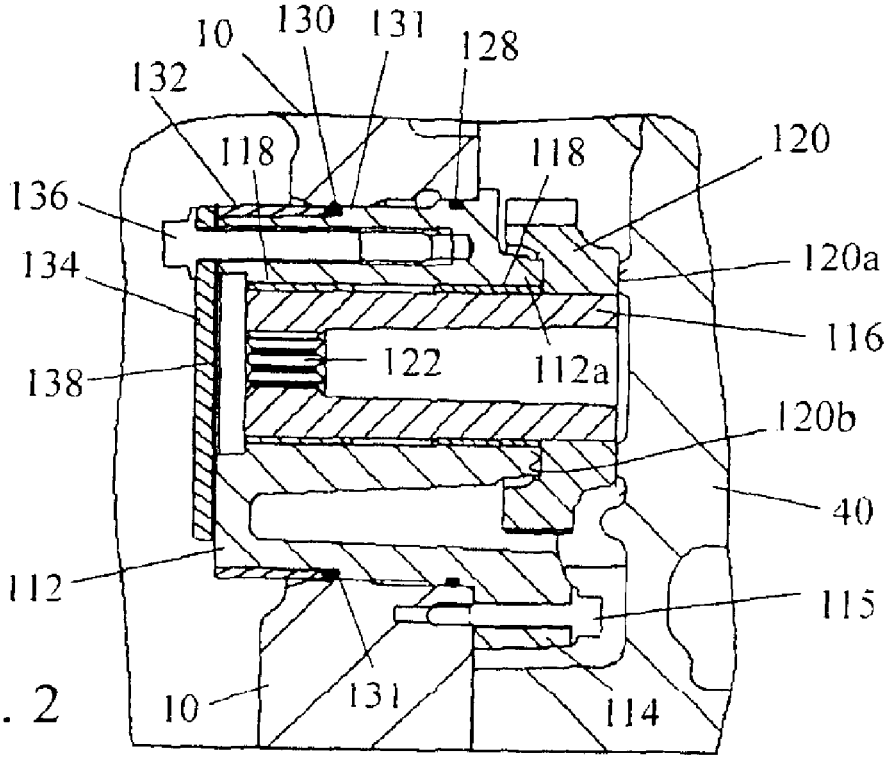
FIG. 2 is a similar section through a drive adapter of the present invention.
Figure 3:
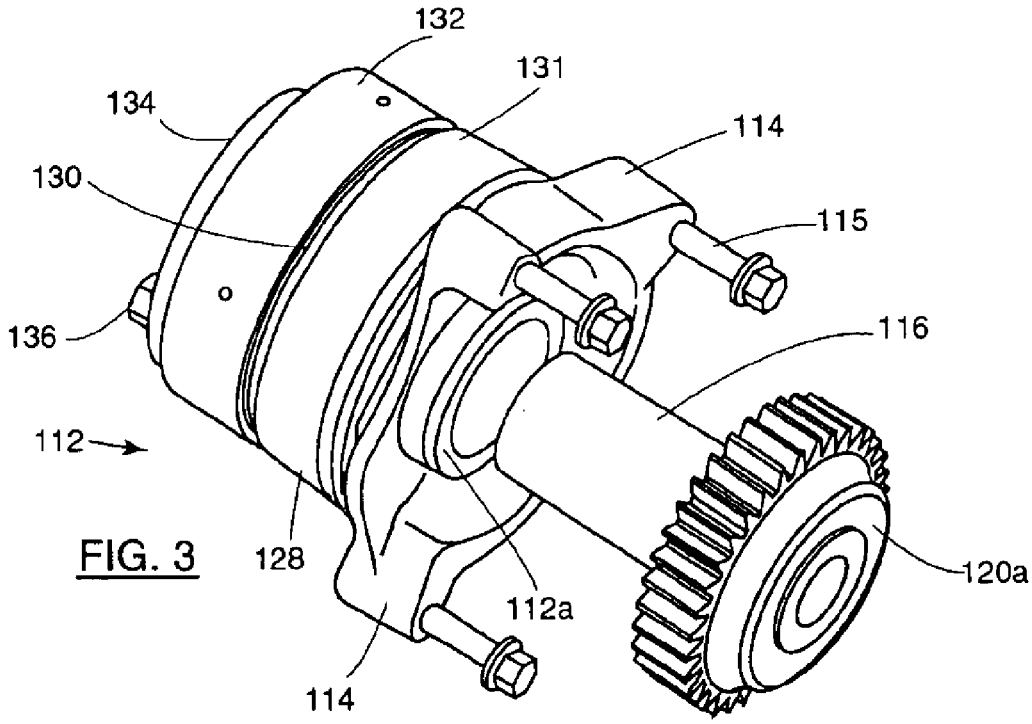
FIG. 3 is a partially exploded perspective view of the drive adapter of FIG. 2.
Figure 4:
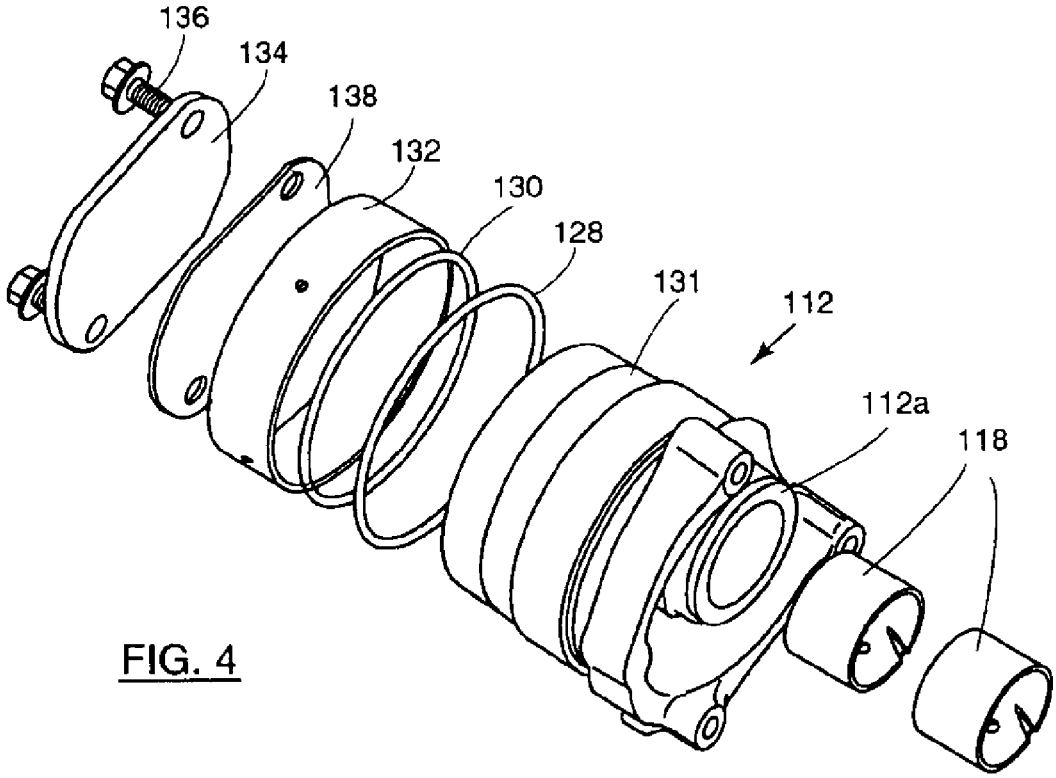
FIG. 4 is an exploded view of the casing of the drive adapter shown in FIGS. 2 and 3.

Referring now to FIGS. 2 to 4, a drive adapter of the invention comprises a casing 112 that fits in the opening in the lateral flange 10 of the engine block and is sealed relative to the opening by a pair of O-rings 128 and 130. The casing 112 had projecting ears 114 that receive bolts 115 to secure the drive adapter to the rear end face of the engine. A drive shaft 116 is supported in the casing on two axially spaced bearing shells 118.

The drive shaft 116 has a constant external diameter and a cog 120 is fixed to its end projecting from the casing 112. The fixing of the cog 120 to the drive shaft 116 is solid, so that the cog can neither rotate relative to the drive shaft 116 nor move axially relative to it. The fixing of the cog 120 on the drive shaft 116 can be performed in any suitable manner, for example the cog 120 may be an interference fit or a shrink fit on the drive shaft 116 or else the drive shaft 116 may be formed with a flat engaged by a grub screw in the cog 120.

The cog 120 has a forward facing annular surface 120*b* that abuts a collar 112*a* (best seen in FIGS. 3 and 4) that projects from the casing 112 around the shaft 116. This forms a first axial thrust bearing surface to withstand forces tending to move the drive shaft 116 to the left as viewed in FIG. 2. The cog 120 also has a rearward facing annular surface 120*a* that abuts the cover 40 fitted over the engine flywheel to withstand axial loads urging the drive shaft 116 to the right as viewed in FIG. 2.

The drive shaft 116 is hollow and its end remote from the cog 120 is broached internally to form a splined connector 122. This acts as a coupling for receiving the externally splined front end of the input shaft of the ancillary unit, such as a hydraulic pump, that is to be driven by the engine through the drive adapter.

Oil for lubrication of the drive shaft bearing shells 118 is fed through a suitable opening (not shown) into the space between the two bearing shells 118 and flows axially past the shells 118. The oil that passes the shell 118 shown to the right in FIG. 2 serves also to lubricate the axial bearing surface 120*b*. The oil that passes the shell 118 shown to the left in FIG. 2 acts to lubricate the splined coupling 122. The bearing surface 120*a* is lubricated by oil dripping along the cover 40 and by oil passing the splined coupling 122 and flowing through the hollow shaft 116. It will be seen in FIG. 2 that the bearing surface 120*a* contacts a raised ridge of the cover 40 and it is preferred that the ridge be formed as a crescent (rather than as a continuous ring) with an upward facing opening so as to act as a collector for oil draining along the surface of the cover 40. In case too much oil should collect within the shaft, it is possible to provide a small drainage hole to enable surplus oil to drip back into the flywheel housing.

The oil enters the casing 112 from, the engine through a gallery formed in the space between the two O-rings 128 and 130. If oil should pass the O-ring 128 then it will only flow into the flywheel housing and will not leak. However, oil that flows past the O-ring 130 will escape from the engine and form an undesirable leak.

In the prior art drive adapter, in the event of failure of the equivalent O-ring 30, it could only be replaced by removal of the drive adapter from the engine and this would entail separating the engine from the gearbox. By contrast, in the embodiment of the invention illustrated in FIGS. 2 to 4, this task is simplified in that the O-ring 130 is held in place by a retaining sleeve 132 which can be removed while the drive adapter remains in place. After the sleeve 132 has been withdrawn axially, the O-ring 132 can be removed, for example it can be teased out with a pin, and its replacement will be pushed into position when the sleeve 132 is again slid over the end of the casing 112. A seal is achieved in that the O-ring is deformed radially as a result of the ring being clamped axially between the end of the retaining sleeve 132 and the facing shoulder 131 on the casing 112.

Prior to the mounting of the ancillary unit to the drive adapter, a temporary cover plate 134 is used to close off the end of the casing 112 and to hold the retaining sleeve 132 in position. The cover 134 is held by means of bolts 136 that engage in the mounting holes for the ancillary unit and a gasket 138 is used to seal against oil leaks, if the engine is operated without the ancillary unit in place.

The drive adapter is mounted on the engine before the gearbox is fitted to the engine. At this time the axial end face of the engine is exposed and the casing 112 can be secured in position by means of the three bolts 115. The drive shaft 116 and its cog 120 can now be inserted into the casing 112 and once the flywheel cover is mounted on the engine, the cog 120 will be held captive between the engine and the flywheel cover preventing axial movement of the drive shaft 116.

To mount the ancillary unit on the engine, the cover plate 134 is removed and the bolts 136 are used to secure the ancillary unit to the drive adapter in its place. Torque can then be transmitted from the engine driven gear that meshes with the cog 120 to the drive shaft 116 and through the splined coupling 122 to the input shaft of the ancillary unit.

Having thus described the invention what is novel and desired to be secured by Letters Patent of the United States is:

What is claimed is:

1. An ancillary unit drive adapter for use in an engine block which has at one end a lateral flange formed with an aperture for mounting of the ancillary unit, the drive adapter comprising a casing for mounting on the end face of the engine to overlie the aperture, a shaft journalled in the casing, a formation at one end of the shaft to enable the shaft to be coupled to the input shaft of the ancillary unit and a cog solid with the opposite end of the shaft for meshing with an engine driven gear, and characterised in that faces on the opposite sides of the cog serve in use as bearing surfaces to withstand axial forces acting in both directions on the drive shaft further comprising a cover encasing the end face of the engine, which cover is formed with a raised ridge for contacting the bearing surface on the cog to limit axial displacement of the drive shaft.

2. A drive adapter according to claim 1, characterized in that the part of the drive shaft engaged by the cog has the same diameter as the part journalled in the casing.

3. A drive adapter according to claim 2, characterized in that the drive shaft is formed as a hollow shaft.

4. A drive adapter according to claim 3, characterized in that an internally splined coupling is formed by broaching one end of the shaft.

5. A drive adapter according to claim 4, characterized in that a drainage hole is provided to permit oil collecting in the hollow shaft to drain away in use into the housing of the engine flywheel.

6. A drive adapter according to claim 5, characterized in that the drive shaft is eccentrically mounted within the casing.

7. An engine fitted with an adapter according to preceding claim 1, wherein said axial surface is a raised ridge.

8. An engine according to claim 7, characterized in that the ridge is crescent shaped and has an upward facing opening so as to act as a collector for oil draining down the cover, the collected oil serving to lubricate the bearing surfaces between the cog and the ridge.

* * * * *